US007553067B2

(12) United States Patent
Perret et al.

(10) Patent No.: US 7,553,067 B2
(45) Date of Patent: Jun. 30, 2009

(54) TIMEPIECE HAMMER

(75) Inventors: Laurent Perret, La Chaux-de-Fonds (CH); François Trifoni, Le Locle (CH); Stephen Forsey, Le Locle (CH)

(73) Assignees: Vaucher Manufacture Fleurier S.A., Fleurier (CH); CompliTime SA, La Chaux-de-Fonds (CH)

( * ) Notice: Subject to any disclaimer, the term of this patent is extended or adjusted under 35 U.S.C. 154(b) by 0 days.

(21) Appl. No.: 12/094,780

(22) PCT Filed: Nov. 21, 2006

(86) PCT No.: PCT/EP2006/068694

§ 371 (c)(1),
(2), (4) Date: May 23, 2008

(87) PCT Pub. No.: WO2007/060152

PCT Pub. Date: May 31, 2007

(65) Prior Publication Data

US 2008/0291785 A1 Nov. 27, 2008

(30) Foreign Application Priority Data

Nov. 24, 2005 (EP) ..... 05111267

(51) Int. Cl.
*G04F 7/00* (2006.01)

(52) U.S. Cl. ..... 368/106; 368/101

(58) Field of Classification Search ..... 368/101–106
See application file for complete search history.

(56) References Cited

U.S. PATENT DOCUMENTS

| | | | | |
|---|---|---|---|---|
| 809,196 | A * | 1/1906 | Loker | 368/106 |
| 2,641,899 | A * | 6/1953 | Jeanneret | 368/103 |
| 3,518,826 | A * | 7/1970 | Takashina | 368/106 |
| 3,643,422 | A | 2/1972 | Bachmann | |
| 3,796,041 | A | 3/1974 | Boult | |
| 3,901,020 | A * | 8/1975 | Capt et al. | 368/105 |
| 7,331,706 | B2 * | 2/2008 | Gabathuler et al. | 368/106 |

* cited by examiner

*Primary Examiner*—Vit W Miska
*Assistant Examiner*—Sean Kayes
(74) *Attorney, Agent, or Firm*—Young & Thompson

(57) ABSTRACT

A clockwork movement hammer (1) is used for interacting with heart-shaped cams (20, 21) provided with corresponding axes of rotation (29, 30) which are positioned remotely to each other. More precisely, the hearts (20, 21) are connected to a chronograph timer, whereas the hammer belongs to the resetting mechanism of the chronograph timers. The inventive hammer (1) includes at least one first part (5) movably mounted on the clockwork bottom plate (2) and one second part (17) bearing supporting surfaces (13, 19) which can be bring into contact with the hearts (20, 21) . The two parts (5, 17) of the hammer (1) are connected to each other by at least one swivel-type connection (14, 24) for making it possible to adjust the corresponding positions of the supporting surfaces (18, 19) while a resetting process. Due to particular characteristics thereof, the structural design of the hammer (1) is simple and small-sized.

10 Claims, 2 Drawing Sheets

TIMEPIECE HAMMER

TECHNICAL FIELD

The present invention relates to a clockwork movement hammer designed to cooperate with at least one first and one second heart-pieces of the movement having corresponding axes of rotation located apart from each other. The hammer comprises in particular at least two parts, a first of which is designed to be mounted on the movement so as to be mobile in relation thereto. The second part comprises at least two support surfaces designed to cooperate with the first and second heart-pieces, respectively. The first and second parts of the hammer are connected to each other so as to allow limited movement of one of the parts in relation to the other.

Typically, this type of hammer is used in chronograph movements to return the organs indicating time measured to zero. Generally, the first part of the hammer is maintained on the plate of the movement by a stepped screw allowing the hammer to pivot to perform its return-to-zero function. In fact, the chronograph movement comprises, in principle, one or several heart-pieces, integral with the chronograph mobiles, themselves bearing organs to indicate time measured. These heart-pieces are designed to be struck by the hammer launched into a rotational or translational movement, under the pressure of a spring, in response to the activation of an external return-to-zero control member. For this purpose, the hammer comprises support surfaces designed to come into contact with the periphery of the corresponding heart-pieces to drive them in rotation, then maintain them in a predefined position when the organs indicating time measured are returned to their respective initial positions. It is crucial for these support surfaces to be arranged precisely in relation to each other, on one hand, and each in relation to the corresponding heart-piece, on the other, such that the indicator organs resume their initial positions with good precision and simultaneously. To achieve this result, it is sometimes necessary to adjust or correct the hammer.

STATE OF THE ART

Various solutions have been proposed to meet the above-mentioned requirements, in particular hammer structures comprising several component parts whereof the relative positions or orientations are adjustable, for example, using eccentrics.

More particularly, chronograph movement provided with return-to-zero hammers meeting the definition provided above have already been described in the prior art.

Indeed, patent U.S. Pat. No. 3,643,422 (EBAUCHES BETTLACH SA) describes a chronograph movement comprising a return-to-zero hammer made in two main parts, connected to each other so as to allow limited movement of one of the parts relative to the other. A first part of this hammer, the body, is rotatably mounted on the plate of the movement, while the second part, the lever, comprises two bosses designed to cooperate with two heart-pieces of the movement.

From the perspective of their connection, it is planned to arrange a protrusion having a generally triangular shape, in one of the edges of the hammer lever, the top of which is arranged bearing against an edge of the hammer body to define a pivot point of the lever relative to the body. The hammer lever is also engaged between two tabs of the hammer body which extend on both sides of the ends of the lever so as to prevent said lever from moving in the direction of its length. Moreover, each of these tabs has an engaging rim, the two rims making the hammer lever integral with the body. The solution proposed in this American patent does, however, present a significant drawback due to the means implemented to keep the lever in contact with the hammer body, namely a relatively significant bulk of the hammer in the regions located around the support planes of the lever. Such a bulk may be incompatible with the current requirements of high horology, which is tending to develop movements with growing complications while also trying to preserve the dimensions that are acceptable for the cases housing these movements.

U.S. Pat. No. 3,796,041 (Smiths Industries Limited) also describes a chronograph movement comprising a return-to-zero hammer in two parts. A first part is pivotably mounted on the plate while being able to be actuated by a lever controlled from an external control member. This first part supports the second part, via a pin around which the two parts are free to turn relative to each other. Moreover, an additional pin is provided, integral with the second part and engaged in a hole arranged in the first part, to limit the amplitude of the relative rotations between the two parts while also arranging a certain play between them. The structure described does, however, have a substantial bulk in its thickness due to the fact that the two parts must be at least partially superimposed to enable their connection. Moreover, this bulk happens in the immediate vicinity of the support surfaces designed to cooperate with the return-to-zero heart-pieces, which leads to constraints for the designer in the arrangement of the chronograph counters.

BRIEF DESCRIPTION OF THE INVENTION

The primary aim of the present invention is to simplify the known structures of the prior art. Additional objectives of the present invention aim to improve the reliability of the devices of the prior art and, in particular, improve their behavior over time and with wear.

To this end, the present invention relates to a return-to-zero hammer of the type mentioned above, characterized by the fact that at least one organ of the first part of the hammer is connected to an organ of the second part of the hammer via a ball and socket joint formed, on one hand, by a protuberance having a disc-shaped principal portion and arranged on one of the parts of the hammer and, on the other hand, by a recess arranged in the other part of the hammer and having a shape substantially complementary to that of the protuberance.

A ball and socket joint advantageously enables the second part of the hammer to pivot to a certain extent relative to the first part, so as to promote a simultaneous return-to-zero of all of the heart-pieces. The specific structure of a ball and socket joint also advantageously serves to keep the second part of the hammer in contact with the first part. Thus, it is not crucial to provide additional means to return the second part of the hammer when the first part moves in relation to the movement to release the heart-pieces.

According to one preferred embodiment, the ball and socket joint is arranged between the support surfaces of the second part of the hammer in the longitudinal direction thereof.

Moreover, one can advantageously provide that a first of the support surfaces is arranged at the level of a first end of the second part of the hammer, while its second end is engaged inside a recess which has a complementary shape provided in the first part of the hammer. This last connection makes it possible to further improve the stability of the mechanical connection arranged between the first and second parts of the hammer.

BRIEF DESCRIPTION OF THE DRAWINGS

Other characteristics and advantages of the invention will appear more clearly upon reading the detailed description which follows, done in reference to the appended drawings presented as non-limiting examples and in which.

DETAILED DESCRIPTION OF THE INVENTION

Figure 1:
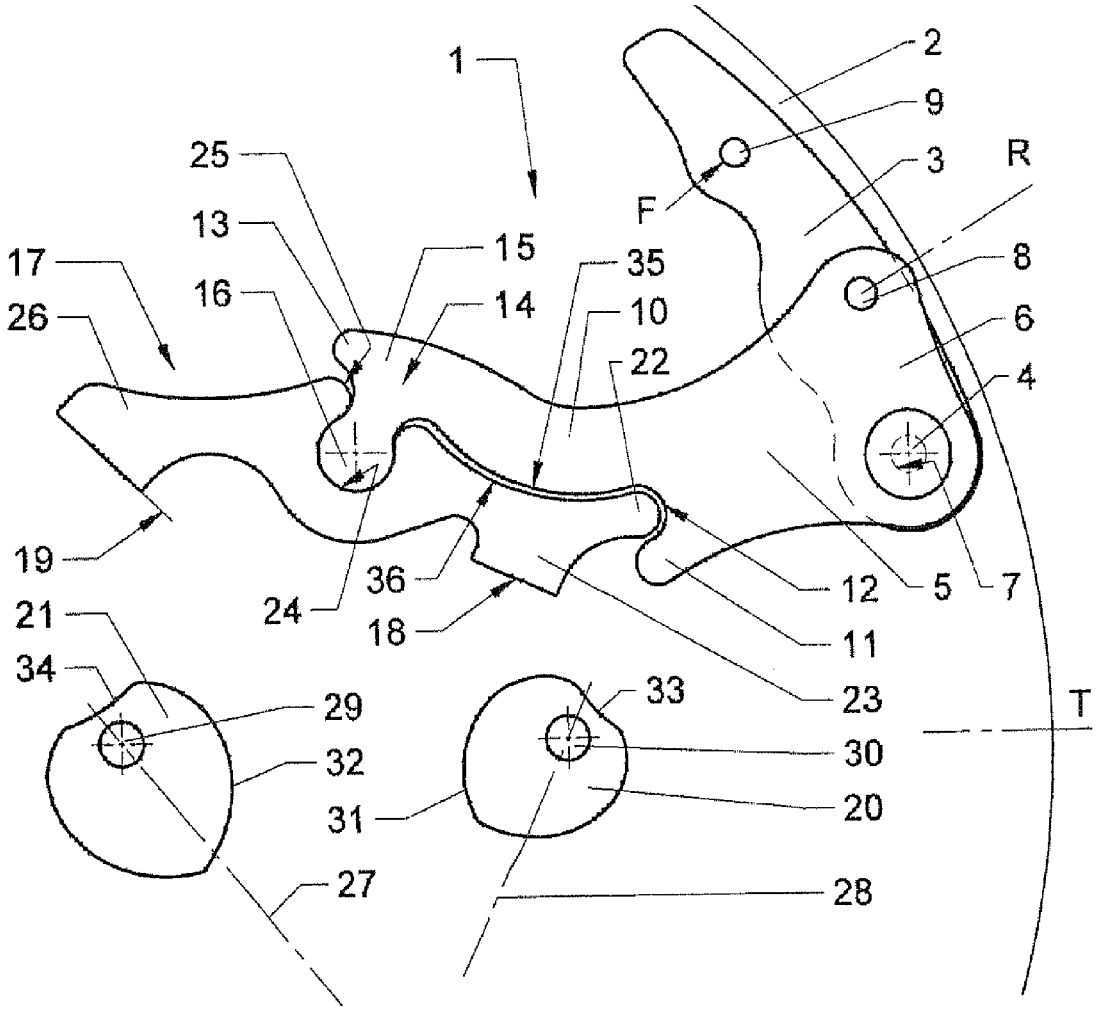
FIG. 1 shows a simplified elevation view of the return-to-zero organs for chronograph movement according to one preferred embodiment of the present invention, the return-to-zero hammer being shown in its locked position.

FIG. 1 shows a simplified elevation view of a chronograph movement comprising a return-to-zero hammer 1 according to one preferred embodiment of the present invention. Only the elements of the chronograph movement which are essential to a good understanding of the invention have been shown.

In the following description, the position of certain components is sometimes defined in reference to an hour. This position corresponds to that occupied, on a conventional dial, by the index displaying the given hour.

A small peripheral portion of the clockwork movement plate 2 of has been shown in the return-to-zero control region, whereof the lever 3 is visible in the drawing. The return-to-zero lever 3 is arranged to be actuated by an external control member (not shown), diagrammed by an axis line bearing the reference R in the figures. More specifically, the lever 3 has a ball and socket joint with the plate 2 and undergoes a rotational movement relative to the plate 2 in response to a pressure exerted on the external control member. The ball and socket joint is provided by an axis or a post 4 which can be press-fitted in a hole (not shown) of the plate, which has corresponding dimensions. Alternatively, one can provide for using a stepped screw screwed into the plate 2 whereof the step also makes it possible to ensure good maintenance of the lever 3 in the direction of its axis of rotation.

The position of a setting organ or stem (not shown) was also diagrammed by an axis line bearing the reference T. As non-limiting information, one can note that, when the clockwork movement is mounted in a case to assemble a timepiece, the axis R is positioned at four o'clock while the axis T is positioned at three o'clock.

A lever 5 of the return-to-zero hammer 1 is mounted integral with the return-to-zero lever 3, by its base 6, so as to be moved in response to an action on the external return-to-zero control member.

The nature of the movement of the hammer lever 5 is not directly connected to the present invention and can be of any type adapted to the implementation of the invention. Thus, in the present embodiment, the lever 5 is arranged so as to be able to pivot relative to the plate 2 of the clockwork movement, like the return-to-zero lever 3. One sees in particular, in FIG. 1, that the base 6 of the hammer lever 5 comprises an opening 7 inside which the post 4 is arranged, this thereby also constituting an axis of rotation for the hammer 1.

The two levers 3 and 5 can be made integral using any adapted means making it possible to ensure the transmission of a rotation of the return-to-zero lever 3 to the hammer lever 5 without going outside the framework of the present invention. One can for example provide that the base 6 of the lever 5 is welded on the face of the return-to-zero lever 3 against which it rests, or alternatively that the return-to-zero lever 3 and the hammer 1 are formed in a single piece.

The two levers 3 and 5 can also be made in the form of two pieces independent of each other and arranged so as to pivot around the post 4. One can then provide an element of the return-to-zero device arranged to act simultaneously on both levers in response to an activation of the external control member and drive their simultaneous rotation.

According to one preferred variation of the present invention, as visible in FIG. 1, the return-to-zero lever 3 is provided with a pin 8 press-fitted in a hole (not referenced) arranged in the region of the lever 3 superimposed in relation to the base 6 of the lever 5. The base 6 also comprises a hole adapted to house the pin 8 and thereby make the hammer lever 5 integral with the return-to-zero lever 3 of the rotational movements.

The return-to-zero lever 3 comprises an additional pin 9 in its part remote from the post 4 designed to serve as support for the end of a spring (not shown) exerting a force on the lever 3, this force being diagrammed by an arrow referenced F, tending to maintain it in its locked position, i.e. in the position shown in FIG. 1. One preferably provides a notching done conventionally on the spring to allow rapid action of the return-to-zero control.

The hammer lever 5 first extends, from its base 6, in a direction substantially perpendicular to the longitudinal direction of the return-to-zero lever 3, in other words in the direction of the axis line R. The lever 5 then has a division, in its longitudinal direction, between a principal portion 10 which extends longitudinally, having a bend, and a secondary portion forming an protrusion 11 on the periphery of the hammer lever 5 oriented toward the center of the clockwork movement. The junction between the principal portion 10 and the protrusion 11 defines a recess 12 formed substantially in a circle arc. The association of the principal portion 10, the protrusion 11 and the recess 12 forms a lip, the function of which will be described below.

The principal portion 10 ends with a fine and rounded end 13 near which a protuberance 14 is arranged, this protuberance being oriented in the direction of the clockwork movement center. The protuberance 14 has a first substantially rectilinear portion 15 followed by a second generally disc-shaped portion 16 which has a diameter greater than the width of the first portion 15.

The hammer 1 comprises a second principal part 17 partially cased in the first part, i.e. the hammer lever 5. The second part 17 of the hammer 1 bears support surfaces 18 and 19, specifically two in the embodiment shown non-exhaustively in the figures, designed to be moved in contact with the heart-pieces 20 and 21 during the return-to-zero operation of the chronograph counters.

The second part 17 of the hammer has a generally elongated shape and comprises a first end 22 formed in a tongue whereof the dimensions correspond substantially to the dimensions of the lip defined by the principal portion 10 and the protrusion 11 of the hammer lever 5.

From the end 22 and in the longitudinal direction of the second part 17 of the hammer, one finds a first flat support surface 18 whereof the normal is oriented from the side of the clockwork movement center, the support surface 18 being arranged at the end of a first short arm 23. Further in the same direction, the second part 17 of the hammer widens and comprises a recess 24 open from the side of clockwork movement periphery and generally circular in shape, a narrowing 25 being provided in the region of the opening. The diameter of the recess 24 is very slightly larger than the diameter of the protuberance 14 of the hammer lever 5. Likewise, the width of the narrowing 25 is very slightly larger than that of the first part 15 of the protuberance.

The second part 17 of the hammer 1 then has a reduced width relative to that of the region of the recess 24 to end in a second hammer arm 26 bearing the second flat support surface 19, the normal of which is also oriented from the side of the clockwork movement center.

One sees in FIG. 1 that, while the tongue 22 is arranged inside the lip of the hammer lever 5, the recess 24 cooperates with the protuberance 14 so as to define a mechanical ball and socket joint between the first and second parts of the hammer.

The heart-pieces 20 and 21 were shown diagrammatically insofar as they are conventional and do not present any particular difficulties for one skilled in the art. Each of the heart-pieces is mounted on a chronograph counter mobile (not shown for more clarity) bearing a hand indicating a timed unit of time.

Thus, a hand 27 indicating the timed second and a hand 28 indicating the timed minute have been diagrammed in the figures. The hands 27 and 28 were shown in any respective positions in FIG. 1, which corresponds to a situation in which the chronograph function is active, the hammer 1 being raised to allow rotation of the heart-pieces 20, 21 of the chronograph mobiles relative to their respective axes of rotation 29 and 30.

One can note that the timed second mobile is, commonly, arranged at the center of the clockwork movement, the indication of the measured second being done by a large second hand centered on the chronograph dial. In this case, which corresponds to the embodiment shown in the figures, the axis of rotation 29 cuts through the center of the clockwork movement.

One can moreover note that maintaining of the return-to-zero lever 3 and the hammer 1, in a direction parallel to that of its axis of rotation, can be done in various ways without going outside the framework of the present invention. In particular, one can provide, for information, that a small plate (not shown) covering the base 6 of the hammer and the return-to-zero lever 3 is screwed in the plate to ensure its axial maintenance. In this case, one can provide that the pin 9 of the return-to-zero lever 3 has a length such that it shows on the surface of the small plate located on the side of the plate to contribute to the stability of the lever 3. Preferably, the clockwork movement can also be arranged such that the hammer is at least partially inserted between the regions of the barrel-bar, on one hand, and regions of the chronograph bar, on the other. As a result, the hammer 1 is only free to move inside a plane merged with its median plane.

From an operational perspective, when the chronograph function is stopped, conventionally, i.e. generally using a control member (not shown) arranged at two o'clock, the chronograph mobiles are kept immobile in any position, which maybe that of FIG. 1, for example. For the implementation of the stop function of the chronograph in particular for locking of the chronograph mobiles making it possible to read the time measured, one can use a brake system, or any other adapted system known by one skilled in the art, without going outside the framework of the present invention.

From this state, when the return-to-zero lever 3 is actuated, the return-to-zero hammer 1 is lowered such that the support surfaces 18 and 19 are moved until they come into contact with the heart-pieces 20 and 21. As previously mentioned, it is preferable to implement a notching on the helical spring of the return-to-zero lever 3 such that the movement of the hammer 1 is sufficiently fast during activation of the return-to-zero.

When the support surfaces 18 and 19 come into contact with the head-pieces 20 and 21, respectively, the first contact is established with a curved part 31, 32 of the periphery of each of the heart-pieces insofar as none of the timed time counters are at zero. The pressure of the hammer undergone by each of the heart-pieces causes its rotation until each bearing surface is in contact with a recess 33, 34 of the periphery of the corresponding heart-piece.

Figure 2:
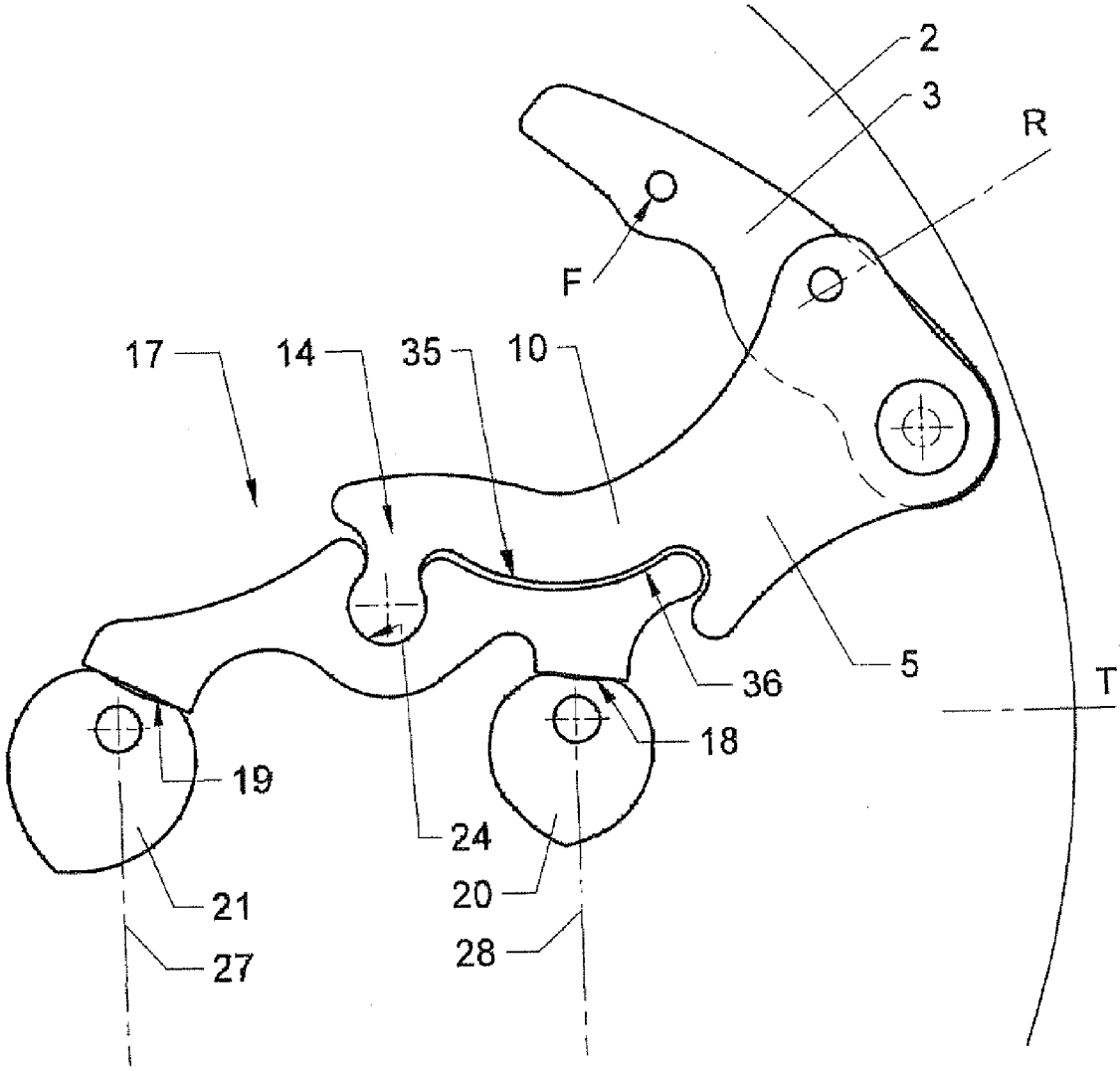
FIG. 2 shows a view similar to that of FIG. 1, the hammer playing a return-to-zero role for the chronograph counters.

The latter situation is illustrated in FIG. 2, the operation of the return-to-zero being completed. The recess 33, 34 of each heart-piece has a shape making it possible to improve the precision and stability of the positioning of the head-pieces relative to the zero position, in a known manner.

When the return-to-zero operation is activated, following the respective orientations of the heart-pieces 20 and 21, the support surfaces 18 and 19 do not necessarily come into contact with the corresponding heart simultaneously. The structure of the hammer 1 according to the present invention advantageously allows the second part 17 of the hammer to pivot in relation to the hammer lever 5, at the level of the ball and socket joint defined above. Moreover, a rotation of this type is possible due to the small play arranged between the tongue 22 of the second hammer part 17, on one hand, and the lip formed around the recess 12 of the lever 5, on the other hand.

Thanks to pivoting of this type, the support surface, which shows a delay during the establishment of contact with the heart-pieces, is driven in a rotational movement making it possible to bring it closer to the corresponding heart-piece more quickly. At the same time, the rotational movement of the second part of the hammer causes a decrease in the pressure exerted by the support surface in advance on the corresponding heart-piece, while very slightly decreasing the speed of rotation. When the initially-delayed support surface comes into contact with the corresponding heart-piece, the second part 17 of the hammer pivots in the opposite direction to enable rebalancing of the pressures respectively applied by the first and by the second support surface on the hearts 20 and 21.

Preferably, one provides for a precise adjustment of the component elements of the ball and socket joint so that the amplitudes of the rotation of this joint are defined directly by the relative dimensions of the first part 15 of the protuberance 14 and the narrowing 25 of the second part of the hammer. The edges of the recess 24 thus define bankings to limit the rotational movements of the first part 15 of the protuberance.

Moreover, one sees in the figures that the respective regions 35 and 36 of the lever 5 and the second part 17 of the hammer located between the ball and socket joint and the lip have complementary shapes. The respective dimensions of the component elements of the ball and socket joint are adjusted so that a small play is arranged between the regions 35 and 36. Thus, one skilled in the art will be able to define the value of this play, without going outside the framework of the present invention and alternatively or complementarily to the solution of the preceding paragraph, so that the region 35 at least partially fills the role of a banking for the region 36 during rotational movements of the second part 17 relative to the hammer lever 5.

From a dynamic perspective, the rotational movement of the second part 17 of the hammer relative to the hammer lever 5 balances the travel of the two support surfaces 18 and 19 to synchronize the return to zero of both timed time counters.

Conversely, when the hammer is raised, as can be the case if the chronograph function is activated from the situation visible in FIG. 2, the particular form of the ball and socket joint allows a good distribution of the tensile forces exerted by the lever 5 on the second part 17 of the hammer, under the effect of a spring. Thus, the two heart-pieces 20 and 21 can be released simultaneously.

One skilled in the art, namely here the maker of clockwork movements, will not encounter any particular difficulties in adapting the respective shapes of the lever 5 and the second part 17 of the hammer according to his own needs during production, to obtain the effects described above, without going outside the framework of the present invention.

It can be seen from the figures that the structure of the hammer according to the present invention has, other than a great simplicity, a reduced bulk in particular near the support surface 19 farthest from the axis of rotation 4. This characteristic is particularly advantageous insofar as this part of the hammer is located in the region of the clockwork movement center. Thus, a significant bulk of the hammer in this region can be problematic for the designer of clockwork movements who must take them into account to arrange other components of the movement there.

Of course, the preceding description corresponds to a preferred embodiment described as a non-limiting example, in particular for the forms shown and described for the first 5 and second 17 parts of the hammer 1. One can, in fact, alternatively provide that the respective sites of the protuberance 14 and the recess 24 are inversed, i.e. the protuberance is arranged on the second part 17 and the recess in the lever 5 of the hammer.

One can also provide, alternatively, that the ball and socket joint is arranged, covering the hammer in its longitudinal direction from the post 4, either before the first support surface 18, or after the second support surface 19. Of course, in either of these two cases, the respective shapes of the first and second hammer parts must be adapted as a result during production, without one skilled in the art encountering any particular difficulties.

One can, however, note that although these last two alternatives have a structural simplicity equivalent to that of the first two to variations above, the latter are still substantially more advantageous from the perspective of bulk near the second support surface 19.

One will also note that the actuation means of the hammer can be made in any manner compatible with the present invention without going outside the framework of the invention.

The invention claimed is:

1. A return-to-zero hammer for clockwork movement designed to cooperate with at least one first and one second heart-piece of said movement having respective axes of rotation located apart from each other, the hammer comprising at least two parts whereof a first is designed to be mounted on said movement so as to be movable relative to the latter, while a second of said parts comprises at least two support surfaces designed to cooperate with said first and second heart-pieces, respectively, said first and second hammer parts being connected to each other so as to allow a limited movement of one of the parts relative to the other, wherein at least one first organ of said first part is connected to a first organ of the said second part by a ball and socket joint formed, on one hand, by a protuberance having a disc-shaped principal portion arranged on one of said parts and, on the other hand, by a recess arranged in the other of said parts and having a shape substantially complementary to that of said protuberance.

2. The hammer according to claim 1, wherein one of said support surfaces is arranged substantially at the level of a first end of said second part of the hammer.

3. The hammer according to claim 1, wherein said ball and socket joint is arranged between said support surfaces in the longitudinal direction of said second part of the hammer.

4. The hammer according to claim 3, wherein one of said support surfaces is arranged substantially at the level of a first end of said second part of the hammer.

5. The hammer according to claim 1, wherein one of said parts of the hammer has at least one retaining lip arranged away from said ball and socket joint and defining a recess toward the inside of said part, the other of said parts of the hammer having a tongue engaged inside said recess.

6. The hammer according to claim 5, wherein said tongue is arranged substantially at the level of a second end of said second part of the hammer.

7. The hammer according to claim 5, wherein said tongue has a shape substantially complementary to that of said recess.

8. The hammer according to claim 7, wherein said tongue is arranged substantially at the level of a second end of said second part of the hammer.

9. The hammer according to claim 1, wherein each of said first and second parts of the hammer has a region arranged between said support surfaces in the longitudinal direction of said second part, said third respective regions having substantially complementary shapes and being arranged substantially bearing against each other.

10. A clockwork movement comprising a return-to-zero hammer designed to cooperate with at least one first and one second heart-piece of said movement having respective axes of rotation located apart from each other, the hammer comprising at least two parts whereof a first is designed to be mounted on said movement so as to be movable relative to the latter, while a second of said parts comprises at least two support surfaces designed to cooperate with said first and second heart-pieces, respectively, said first and second hammer parts being connected to each other so as to allow a limited movement of one of the parts relative to the other, wherein at least one first organ of said first part is connected to a first organ of the said second part by a ball and socket joint formed, on one hand, by a protuberance having a disc-shaped principal portion arranged on one of said parts and, on the other hand, by a recess arranged in the other of said parts and having a shape substantially complementary to that of said protuberance.

* * * * *